US007905040B2

(12) United States Patent
Alterman

(10) Patent No.: US 7,905,040 B2
(45) Date of Patent: Mar. 15, 2011

(54) APPARATUS FOR ALERTING AVAILABILITY OF VACANT POKER TABLE SEATS

(76) Inventor: Alan M. Alterman, Morganville, NJ (US)

( * ) Notice: Subject to any disclaimer, the term of this patent is extended or adjusted under 35 U.S.C. 154(b) by 192 days.

(21) Appl. No.: 12/288,316

(22) Filed: Oct. 20, 2008

(65) Prior Publication Data

US 2009/0077850 A1 Mar. 26, 2009

Related U.S. Application Data

(63) Continuation-in-part of application No. 11/998,753, filed on Dec. 3, 2007, now abandoned.

(60) Provisional application No. 60/975,283, filed on Sep. 26, 2007.

(51) Int. Cl.
*G09F 9/00* (2006.01)

(52) U.S. Cl. ..... 40/320; 40/727; 116/81; 116/DIG. 1

(58) Field of Classification Search ..... 40/320, 40/593, 563, 643, 591; 116/303, 307, 81, 116/DIG. 1; 297/181, 217.2, 463
See application file for complete search history.

(56) References Cited

U.S. PATENT DOCUMENTS

| | | | | | |
|---|---|---|---|---|---|
| 1,240,646 | A * | 9/1917 | Winston | 296/90 |
| 1,348,852 | A * | 8/1920 | Diaz | 40/320 |
| 1,441,911 | A * | 1/1923 | Button | 40/320 |
| 1,841,893 | A * | 1/1932 | Knight et al. | 40/320 |
| 2,331,315 | A * | 10/1943 | Fleming | 5/625 |
| 6,371,367 | B1 * | 4/2002 | Otero | 232/35 |
| 6,511,126 | B1 * | 1/2003 | McAdams | 297/217.1 |
| 2007/0039542 | A1 * | 2/2007 | Schrauwen et al. | 116/313 |

* cited by examiner

*Primary Examiner* — Cassandra Davis
(74) *Attorney, Agent, or Firm* — Charles I Brodsky

(57) ABSTRACT

A sign attached to the back of a poker or blackjack dealer's chair to provide ease of visibility for a casino's floor staff and players waiting to enter a gaming area as to the availability of a vacant seat and as to the betting limits associated with the table, with the sign being operated by a pull-cord arrangement at the dealer's chair.

7 Claims, 4 Drawing Sheets

APPARATUS FOR ALERTING AVAILABILITY OF VACANT POKER TABLE SEATS

CROSS-REFERENCE TO RELATED APPLICATIONS

This application is a Continuation-In-Part of application Ser. No. 11/998,753 filed Dec. 3, 2007, now abandoned entitled Apparatus For Alerting Availability Of Vacant Poker Table Seats. A Provisional patent application covering the invention described herein was filed Sep. 26, 2007, and assigned Ser. No. 60/975,283.

STATEMENT REGARDING FEDERALLY SPONSORED RESEARCH OR DEVELOPMENT

Research and development of this invention and Application have not been federally sponsored, and no tights are given under any Federal program.

REFERENCE TO A MICROFICHE APPENDIX

Not Applicable

BACKGROUND OF THE INVENTION

1. Field of the Invention

This invention relates to filling a vacant seat at a casino gaming table, in general, and to apparatus for alerting the availability of a vacant poker table seat, in particular.

2. Description of the Related Art

As is known and understood, "gaming" is an increasingly popular form of entertainment. Games, particularly games of chance and skill in which one or more players play and place wagers on the outcome, may be played in a variety of ways—most oftentimes at a casino or like venue. Of the various forms of games which are available for play, many are played with playing cards—of which poker is arguably the most popular.

As has been described, poker is traditionally played in a poker room in which a plurality of players are seated at a plurality of poker tables facing a dealer, with the players wagering paper, coin money or chips on a series of playing cards dealt from a deck of fifty-two cards. Given the significant interest in playing poker, many poker rooms are consistently at capacity—especially at casinos. As such, the casino often employs some sort of system to establish a waiting list for new players to fill vacant seats when they become available. Typically, this requires use of a floor staff.

As will also be appreciated by the casino poker player, the room where all this activity is going on is quite frantic—saying the room is "noisy" begs the question; the arrangement being "frenetic" is a better description of the premises.

Usually, the way the floor operations conventionally work is that when a vacant seat becomes available, a floor person simply directs a player from the que of those waiting to the general area where the table awaits. Oftentimes, the dealer at that table just yells as to the availability of a vacant seat—and the players already at that table, as well as the dealer himself/herself, then must wait until the new player locates the table and the vacant seat. Frequently, when arriving there, the new player finds that the particular poker game being played is not one that he/she wishes to participate in—for example, being a "no-limit" game, when the new player is looking for one with a $2.00-$4.00 limit. In declining to participate in such a game, that player then has to return to the que, and the floor person then has to send a second player out to locate the table and vacant seat. Once more, the game being played may not be to that player's liking—and the players there, and the dealer there, similarly have to wait, again, in frustration, until a willing player is seated. Not only does this cut down on the enjoyment of the players already gaming there, but cuts down the number of hands that can be played at that table in any instant of time.

What also leads to the confusion, in delaying any start of a new hand when a vacant seat is to be filled, is that the individual poker tables are not readily "numbered" so as to be noticeable. Even if a floor person were to direct a new player to proceed to "Table No. 6", for example, the absence of visible table numbering just produces a shuffling about of the new player from one table to another in an attempt to locate the table from more than the just general pointing in a particular direction by the floor person. This becomes all the more confusing during "tournament play", when numbered table signs are removed at the start of the tournament, and then players are redirected towards other tables during consolidation of play—i.e., once the table number signs are removed, those players continuing in the tournament experience confusion in finding the tables to which a consolidation takes place, once those table number signs are no longer there.

As will be appreciated, all these traditional manners of supervising the casino room operation makes the poker playing more difficult, makes it more frustrating for the players waiting for a hand to begin, and makes it more costly for the casino operator through the delay in getting hands dealt. As will also be appreciated, these same problems would be understood to exist where other similar table games are being played—such as blackjack, 3 card poker, Caribbean stud poker, etc.

OBJECTS OF THE INVENTION

It is an object of the present invention, therefore, to provide a new and improved manner of alerting the availability of a vacant seat at a gaming table, and particularly at a casino poker room table.

It is an object of the present invention, also, to provide an alerting system of such seat availability in a low technology, low cost manner for the gaming operator to have installed, instructed for use, and operated.

It is an additional object of the invention to provide such an alert system which does not require any use of additional floor personnel to direct "lost" players to the table area to which the player has been assigned to fill a vacant seat in joining the gaming process.

SUMMARY OF THE INVENTION

As will become clear from the following description, the present invention relates to a multi-display poker table sign which may be attached to the back of a dealer's chair showing table limits, seat availability, and table number. In a preferred embodiment of the invention, the alert apparatus includes a multi-sign display attachable to the chair as by a clip connection, including a pole upwardly extending so as to deploy several informational signs. Such signs could incorporate interchangeable indicia showing the table limits and table number—and a flag-type display to identify when seat availability exists.

In usage, when a seat becomes open, the dealer can simply pull a cord along the chair to raise a "seat open" flag to alert the floor staff that a waiting player may be seated there. The flag type of sign, in accordance with the invention, will be positioned behind the dealer, and higher than the dealer's head, so that it would become visible to everyone in the room, without obstructing any play. As will be appreciated, the seat availability flag, the table number and the table limits could be utilized for all table games, and not only the various poker games and blackjack game noted above.

BRIEF DESCRIPTION OF THE DRAWINGS

These and other features of the present invention will be more clearly understood from a consideration of the following description, taken in connection with the accompanying drawings, in which.

As will be understood, such "Seat Open" sign, more generally, could be in the nature of a "flag".

DETAILED DESCRIPTION OF THE INVENTION

Figure 1:
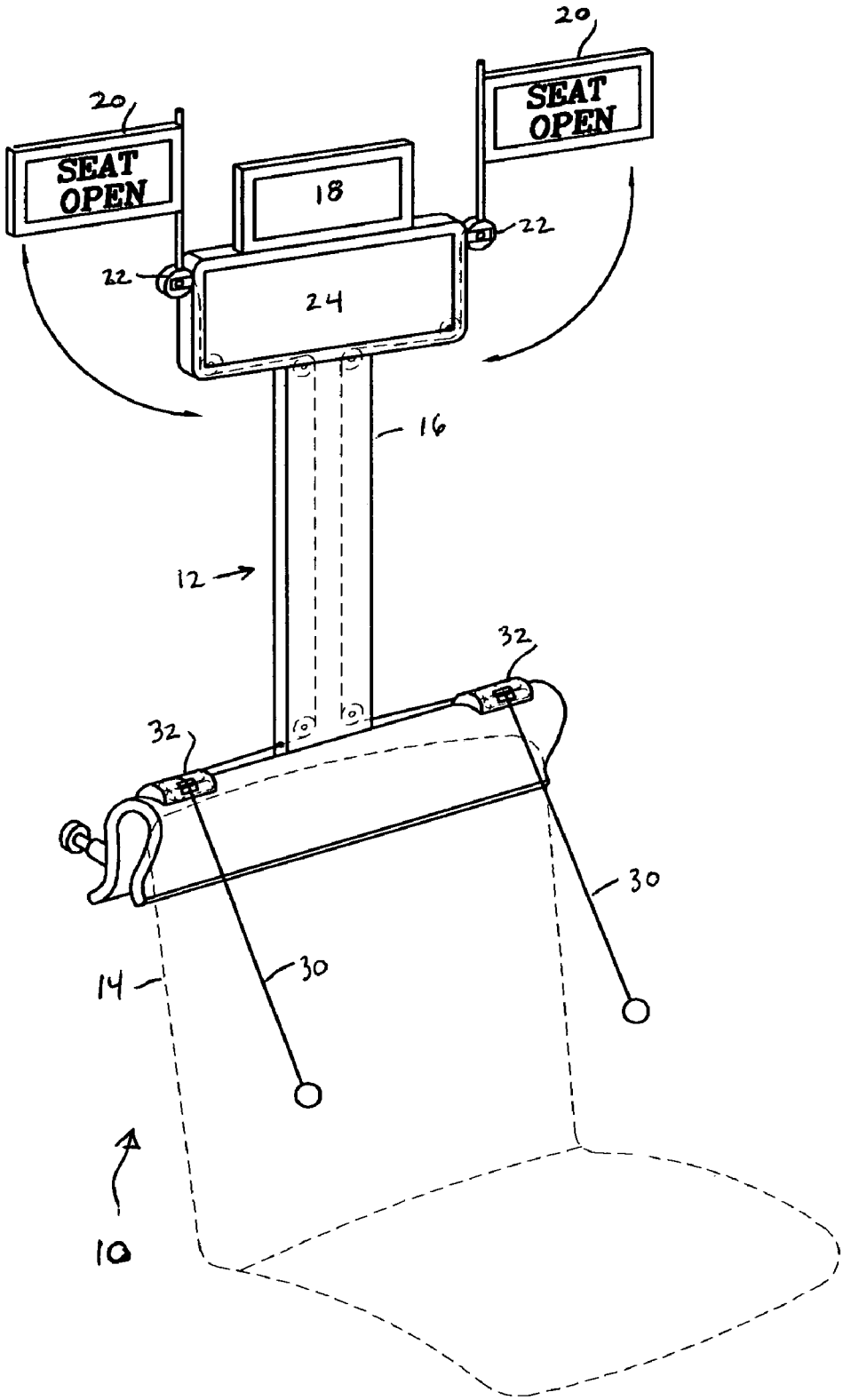
FIG. 1 illustrates a dealer's chair equipped with a multi-display table sign pull cord assembly mechanism for the "Seat Open" display sign embodying the invention, for use at a casino poker room.

As is well known and understood, a dealer of poker or blackjack at a casino or other venue stands (or more usually sits) at one side of the table, by a chip tray, facing the other players. (Such an arrangement, for example, is illustrated in FIG. 1 of United States Patent Application Publication No. 2007/0045958.) If a seat becomes vacant, and is available to a new player, the dealer will either yell that fact to a member of the floor staff (who will try to hear the dealer above all the din of the casino gaming play), or visually signal the vacancy to a floor person.

Figure 2:
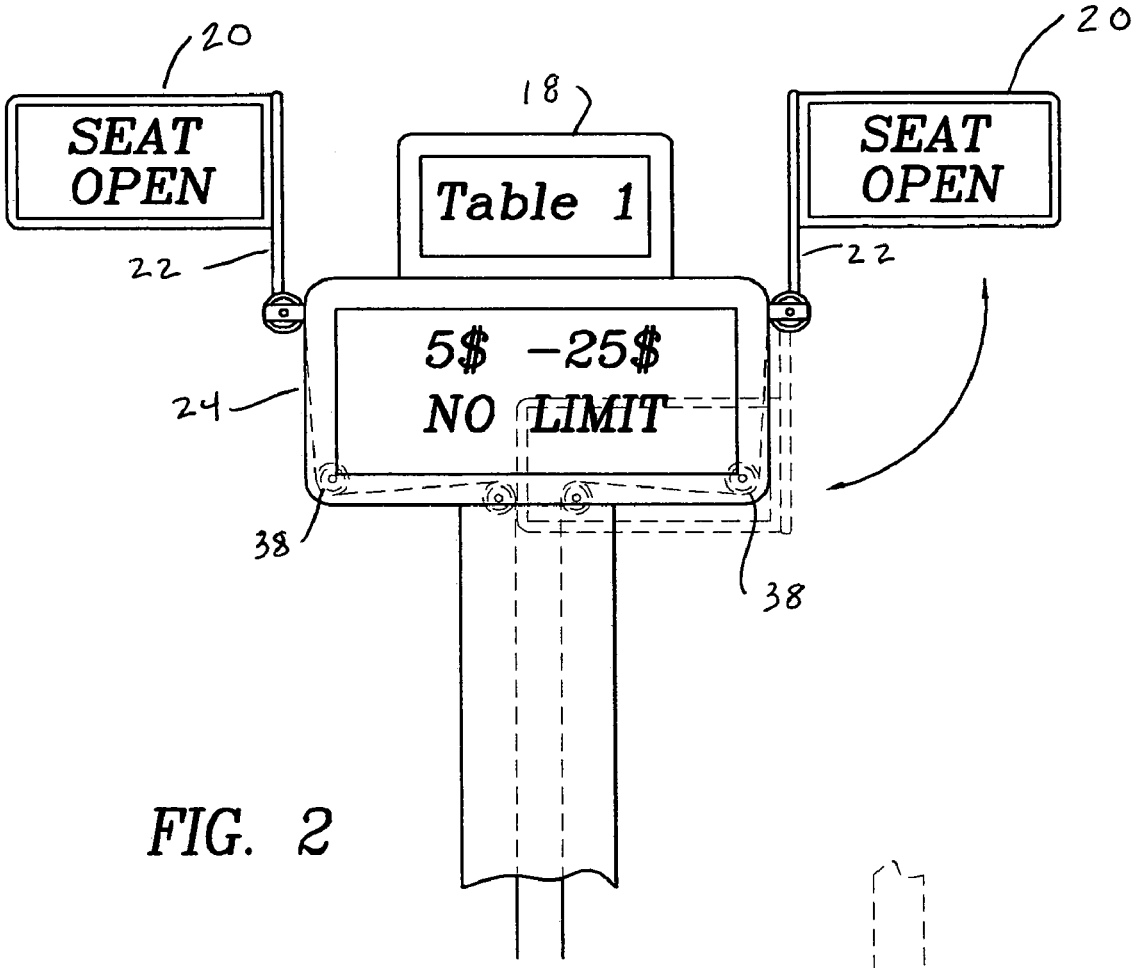
FIGS. 2 and 2A are detailed drawings of the pull cord assembly mechanism which raises and lowers the "Seat Open" sign in manners similar to that with which a window shade cord raises or lowers window shades and blinds.

Recognizing the limitations of such "alerting arrangement", the present invention, as illustrated in the preferred embodiment of FIG. 1, starts off with the dealer's chair, shown by the reference numeral 10 (its seat base not being shown as not being relevant to the operation of the invention). A multi-sign display 12 attaches to the top of the seat back 14 of the dealer's chair 10 in any appropriate manner, and includes an upwardly extending pole or rod 16 (preferably fabricated of metal or plastic). The display 12 also includes a first frame 18 for showing the table number, and one or two signs or flags 20 that lift or unfurl upon actuation to display the notation that one or two seats have become vacant at that table, and are available to waiting players. A bracket 22, joins each sign/flag 20 with a second frame 24 which receives and displays an interchangeable sign, preferably double-sided, setting out the table limits for the table in question. Illustrated in FIG. 2 as being a $5.00-$25.00 no limit table, the interchangeable sign could instead set out the amounts as $5, $10, $15, $20, $5-$25 no limit, etc. As will be appreciated, the pole or rod 16 extends the various informational signs higher than the dealer's head so that they can be seen throughout the room.

As the table gaming amounts are generally established before play begins, all that is required to provide the information as to the availability of a vacant seat is a manner to actuate the sign/flag 20 in some appropriate manner. In keeping with the intention of the invention to have the apparatus as low technology and low cost as possible, the present invention employs a cord 30 running from each sign/flag 20 down along the extension 16 through clips 32 on the display towards the frame, armrest or seat of the chair 10. Each cord 30 operates by raising and lowering one sign/flag. If two seats become vacant, then the second cord is raised to pull the sign/flag and when the seat is filled, the cord is pulled again to lower the sign/flag. With the frame 24 of either a metal or a clear plastic composition, a sign of six inches by fourteen inches may be displayed to advise an approaching player of the table limits for that table, as well as to the number of the table assigned at the frame 18 above it.

Figure 2A:
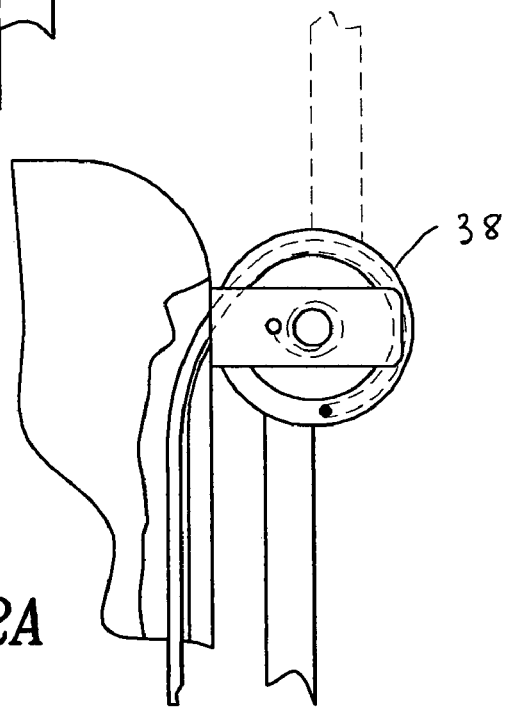
Figure 3:
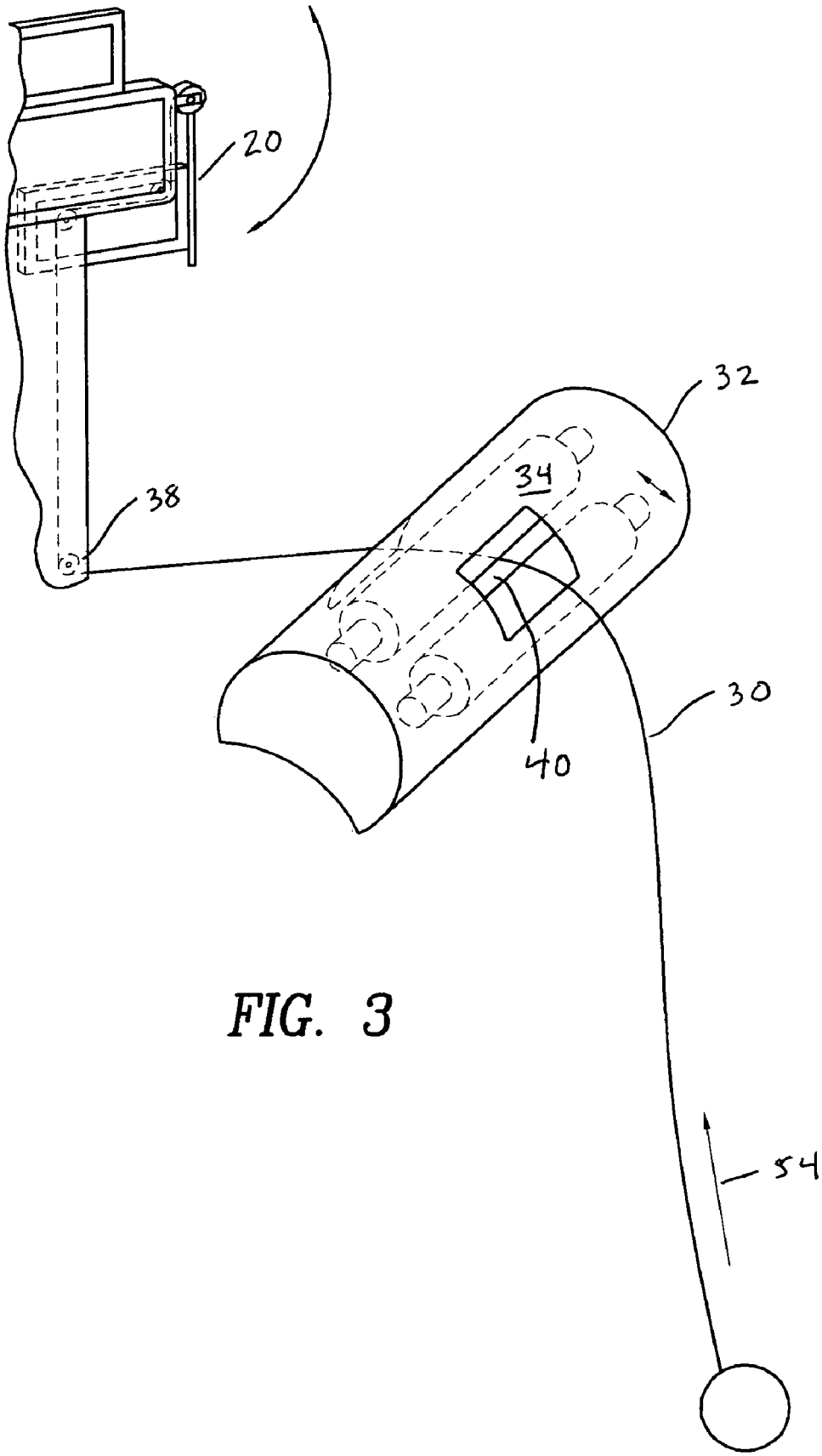
FIGS. 3 and 3A are detailed drawings of the mechanisms that respectively lower and raise the "Seat Open" sign according to the invention.
Figure 3A:
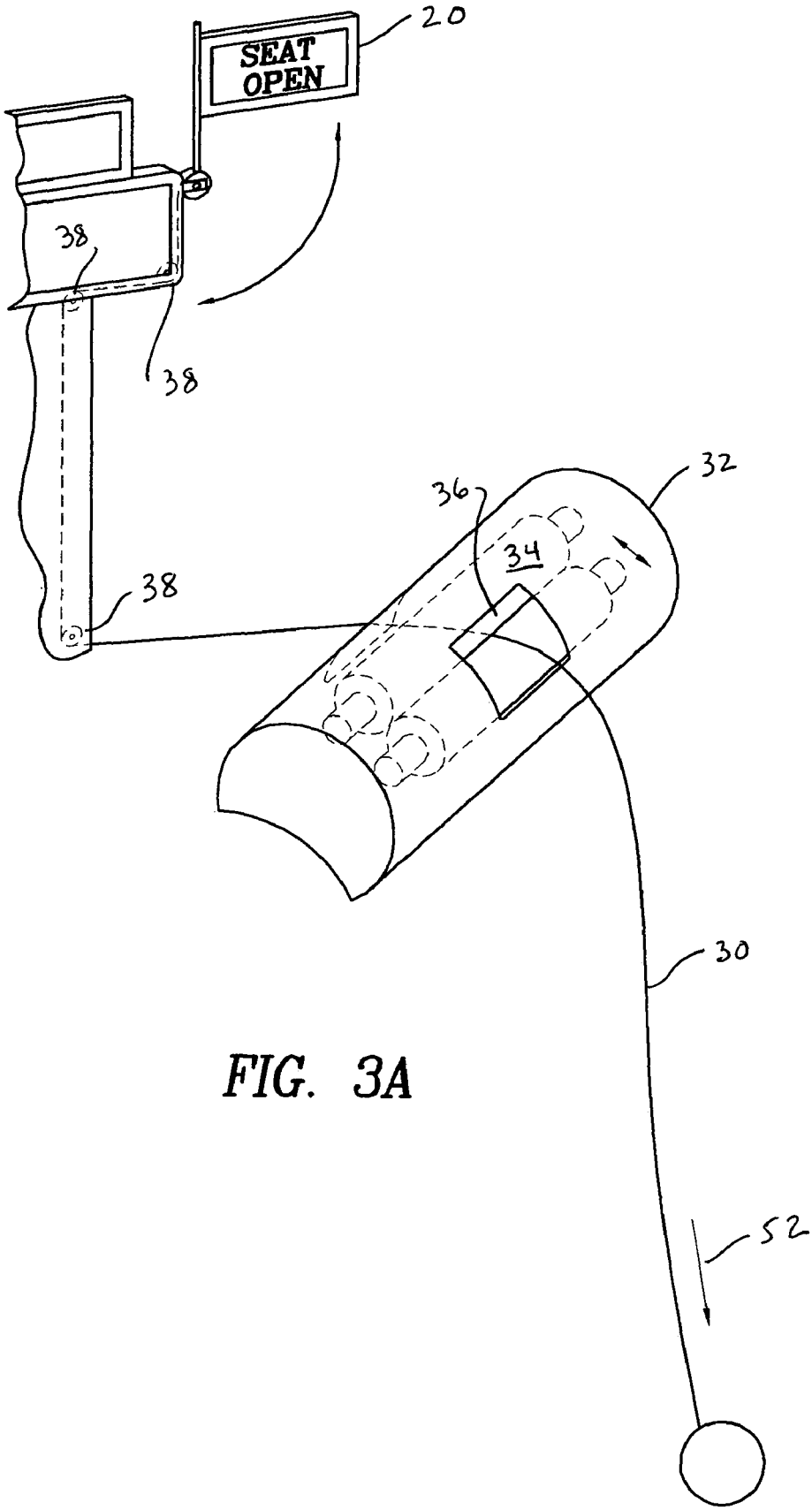

In particular, a pull-cord assembly for the "Seat Open" sign/flag is included within each clip 32 similar to that employed with raising and lowering horizontal version window shades and blinds in which a pulling of a lift cord allows the shade or blind to be pulled upwardly with a sideways rotation then locking it in place—or in any well-known pull cord operations for raising, lowering, and, stabilizing is well understood by those experienced in that technology. FIG. 3A in this respect, illustrates the pulling of the cord 30 downward as shown by the arrow 52 to lift and secure the "Seat Open" sign/flag 20 in the upright position. This is accomplished by pulling the cord 30 through a roller mechanism 34 in the clip 32 in closing a lock included there, as at 36. Such pulling raises the "Seat Open" sign/flag 20 through any appropriate pulley configuration, as shown at 38 in FIG. 3A and FIGS. 2 and 2A.

Once the vacant seat at the table is filled, the dealer would then just pull the same cord 30 free and unlock the roller mechanism 34, in allowing the sign/flag 20 to lower back to its initial position. With the opening of the lock shown at 40, and with the then returning cord shown by the arrow 54, the sign/flag 20 is then lowered (FIG. 3).

In carrying out the invention, the multi-sign display 12 could be fabricated of a light weight so as not to tip-over the dealer's chair whether the dealer is sitting or standing. The cord 30 can be located at the chair so as to be easily moved by feel because the dealer always has to watch the table and the chips on the table being bet, and cannot simply look away for fear of player shenanigans at the table. For those dealer chairs that do not have armrest, the cords 30 could simply be hanging down on the right and left sides to actuate the flags 20. In this manner, yelling at the table as to a vacancy is obviated—and analysis has shown that not only can the apparatus of the invention simplify the seating of players at the table, but can easily eliminate the need for a floor person having to be present to continually direct new players towards available, recently vacated seats. The low technology configuration of the invention would readily be understood as one that would not require any great expense to implement or to utilize. Instruction of the dealers as to its employment will similarly take only a very short amount of time.

While there have been described what are considered to be preferred embodiments of the present invention, it will be readily appreciated by those skilled in the art that modifications can be made without departing from the scope of the teachings herein. For example, any type of appropriate pull-cord assembly could be utilized other than the one described above, as long as the multi-sign display continues to be elevated to a height above the dealer so that its informational content can be easily observed. For at least such reason, therefore, resort should be had to the annexed claims for a true understanding of the scope of the invention.

I claim:

1. Apparatus for a game-room dealer's alerting the availability of a vacant seat at a gaming table comprising:

a multi-sign display attached to a top of a back seat of the dealer's chair, a first sign of which displays indicia identifying the gaming table, a second sign of which displays betting limits at the gaming table, and a third sign of which indicates whether or not a vacant sea& exists at the gaming table;

and a pull-cord system at the dealer's chair coupled with said third sign actuable by the dealer such that the actuation of said pull-cord system in a first manner moves said third sign to a display position at the gaming table while the actuation of said pull-cord system in a second manner removes said third sign from said display position;

and wherein said multi-sign display positions said first, second and third signs above said back seat top for ease of visibility in said game-room.

2. The apparatus of claim 1 wherein said multi-sign display and pull-cord system are removably attachable to the top of the back seat of the dealer's chair.

3. The apparatus of claim 2 wherein said second sign is selectively interchangeable to display differing betting limits at the gaming table.

4. The apparatus of claim 3 wherein said first sign is selectively interchangeable to display differing identifying indicia for the gaming table.

5. The apparatus of claim 4 wherein said first sign is interchangeable to display differing assigned numbers to identify the gaming table.

6. The apparatus of claim 5 wherein said third sign includes a flag, liftable to display in said third sign a seat vacancy at the gaming table upon the actuation of said pull-cord system by the dealer in a first manner, and lowerable to remove said seat vacancy display from said third sign upon the actuation of said pull-cord system by the dealer in a second manner.

7. The apparatus of claim 6 wherein said pull-cord system includes a first cord pullable by the dealer to lift said flag to display in said third sign said seat vacancy, and releasable by the dealer to lower said flag to remove said seat vacancy display from said third sign.

* * * * *